US009887039B2

(12) United States Patent
Ellison

(10) Patent No.: US 9,887,039 B2
(45) Date of Patent: Feb. 6, 2018

(54) MOTORCYCLE IGNITION COIL ASSEMBLY

(71) Applicant: ACCEL PERFORMANCE GROUP LLC, Cleveland, OH (US)

(72) Inventor: Jason Ellison, Elyria, OH (US)

(73) Assignee: Accel Performance Group LLC, Cleveland, OH (US)

( * ) Notice: Subject to any disclaimer, the term of this patent is extended or adjusted under 35 U.S.C. 154(b) by 213 days.

(21) Appl. No.: 14/612,810

(22) Filed: Feb. 3, 2015

(65) Prior Publication Data

US 2015/0311681 A1 Oct. 29, 2015

Related U.S. Application Data

(60) Provisional application No. 61/935,268, filed on Feb. 3, 2014.

(51) Int. Cl.

| | |
|---|---|
| ***H01F 41/04*** | (2006.01) |
| ***F02P 3/02*** | (2006.01) |
| ***H01F 38/12*** | (2006.01) |
| ***F02P 15/00*** | (2006.01) |
| ***F02P 13/00*** | (2006.01) |

(52) U.S. Cl.

CPC ..... *H01F 41/04* (2013.01); *F02P 3/02* (2013.01); *F02P 15/001* (2013.01); *H01F 38/12* (2013.01); *F02P 13/00* (2013.01)

(58) Field of Classification Search

CPC ... H01F 41/04; H01F 38/02; F02P 3/02; F02P 15/001; F02P 13/00

See application file for complete search history.

(56) References Cited

U.S. PATENT DOCUMENTS

| | | | |
|---|---|---|---|
| 4,706,639 | A | 11/1987 | Boyer et al. |
| 4,903,675 | A | 2/1990 | Huntzinger et al. |
| D342,076 | S | 12/1993 | Heismann |

(Continued)

FOREIGN PATENT DOCUMENTS

| | | |
|---|---|---|
| CN | 102061974 | 5/2011 |
| GB | 708559 | 5/1954 |

(Continued)

OTHER PUBLICATIONS

TheGrabulator, "How-To: 600RR coil on plug conversion", Mar. 3, 2012, http://www.rc51forums.com/forums/60-how-articles/6482-how-600rr-coil-plug-conversion.html.*

(Continued)

*Primary Examiner* — Livius R Cazan
(74) *Attorney, Agent, or Firm* — Middleton Reutlinger

(57) ABSTRACT

In accordance with one embodiment, an ignition coil assembly includes an ignition coil cover, a boot, and an ignition coil. The ignition coil cover includes a plurality of fins, an opening, and a channel. The boot includes a slotted opening and a centralized orifice and is configured to be disposed within the opening of the ignition coil cover. The ignition coil includes a seat and a tab. The ignition coil is configured to be disposed within the centralized orifice. The seat is capable of supporting the ignition coil within the centralized orifice of the boot. The tab is configured to be inserted into the slotted opening and the channel when the ignition coil is disposed within the centralized office and the boot is disposed within the opening.

6 Claims, 15 Drawing Sheets

(56) References Cited

U.S. PATENT DOCUMENTS

| | | | | |
|---|---|---|---|---|
| 7,117,860 | B1 * | 10/2006 | Chittum | B62K 19/30 123/195 E |
| D549,241 | S | 8/2007 | Giddens | |
| 7,441,553 | B2 | 10/2008 | Satoh | |
| 7,681,563 | B2 | 3/2010 | Idogawa et al. | |
| 7,789,078 | B2 | 9/2010 | Anzo et al. | |
| 7,849,843 | B2 | 12/2010 | Kojima et al. | |
| RE43,920 | E | 1/2013 | Giddens | |
| D701,535 | S | 3/2014 | Ellison et al. | |
| 9,293,249 | B2 | 3/2016 | Ellison et al. | |
| D776,165 | S | 1/2017 | Ellison et al. | |
| 2009/0194083 | A1 | 8/2009 | Boerjes | |
| 2010/0227715 | A1 | 9/2010 | King | |
| 2012/0017881 | A1 | 1/2012 | Kataoka et al. | |
| 2012/0103313 | A1 | 5/2012 | Idogawa et al. | |
| 2014/0209077 | A1 | 7/2014 | Ellison et al. | |
| 2015/0311681 | A1 | 10/2015 | Ellison | |

FOREIGN PATENT DOCUMENTS

| | | |
|---|---|---|
| GB | 734945 | 8/1955 |
| GB | 821015 | 9/1959 |
| JP | 2000045860 | 2/2000 |
| WO | 20144121101 | 8/2014 |

OTHER PUBLICATIONS

Transmittal Letter of Related Cases dated Mar. 2, 2017.

International Search Report and Written Opinion for PCT/US2014/014205 dated May 27, 2014.

Ducati "Multistrada 1200 ABS—Model Year 2010—Spare parts catalogue No. 915.1.301.1A," retrieved on Nov. 12, 2014 from http://www.ducati.at/uploads/media/MTS1200SABS_Eu_2010.pdf. pp. 78 and 134; Figures 18b(B) and 031, 2 pages.

Canadian Patent Application No. 2,899,870 as filed on Jan. 31, 2014.

European Patent Application No. 14 708 976.7 as filed on Jan. 31, 2014.

United States Design U.S. Appl. No. 29/562,285, filed Apr. 25, 2016.

United States Design U.S. Appl. No. 29/562,289, filed Apr. 25, 2016.

United States Design U.S. Appl. No. 29/562,292, filed Apr. 25, 2016.

United States Design U.S. Appl. No. 29/562,295, filed Apr. 25, 2016.

* cited by examiner

MOTORCYCLE IGNITION COIL ASSEMBLY

RELATED APPLICATION

This application claims the priority of U.S. Provisional Application No. 61/935,268 filed Feb. 3, 2014, which is specifically incorporated in its entirety by reference.

FIELD OF INVENTION

The present disclosure relates to an ignition coil assembly. More particularly, the present disclosure relates to an ignition coil assembly for use with an internal combustion engine of a motorcycle.

BACKGROUND

Ignition coils are systems attached to or integrated with internal combustion engines used with vehicles such as automobiles and motorcycles. Ignition coils are induction coils that cooperate with a vehicle's battery to provide the energy required to power spark plugs. Specifically, the ignition coil typically converts relatively low voltage current from the vehicle's battery to the high voltage current required to generate a spark from the spark plug that ignites the air-fuel mixture within the internal combustion engine.

Ignition coil systems for motorcycles commonly include the ignition coil being positioned remotely from the spark plugs. Typically ignition coils are connected to the spark plugs by high-voltage insulated ignition wires that run from one location on the engine (i.e., the location of the ignition coil) to another location on the engine (i.e., the location of the spark plugs). Such an arrangement can cause clutter in and around the engine, expose the ignition wires to potentially harsh environments, and lead to suboptimal performance of the ignition system and engine.

In some cases, engines can comprise a "coil-on-plug" design, in which an ignition coil is disposed in contact with the spark plug, meaning that no such wire is required. In motorcycles, for example, some such systems are implemented into liquid-cooled engines. Such engines are specifically designed by their manufacturers to accommodate the coil-on-plug arrangement, with structural features built into the engine that hold the coil in position as it mates with the spark plug.

SUMMARY

In accordance with one embodiment, an ignition coil assembly can include an ignition coil cover, a boot, and an ignition coil. The ignition coil cover can include a plurality of fins, an opening, and a channel. The boot can include a slotted opening and a centralized orifice and can be configured to be disposed within the opening of the ignition coil cover. The ignition coil can include a seat and a tab. The ignition coil can be configured to be disposed within the centralized orifice. The seat can be capable of supporting the ignition coil within the centralized orifice of the boot. The tab can be configured to be inserted into the slotted opening and the channel when the ignition coil is disposed within the centralized office and the boot is disposed within the opening.

BRIEF DESCRIPTION OF THE DRAWINGS

In the accompanying drawings, structures are illustrated that, together with the detailed description provided below, describe exemplary embodiments of the invention. Like elements may be identified with the same reference numerals for convenience. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

The apparatuses and methods disclosed in this document are described in detail by way of examples and with reference to the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be and should not be construed as mandatory or limiting unless specifically designated as such. Selected examples of ignition coil assemblies are hereinafter disclosed and described in detail with reference made to figures.

Disclosed herein are exemplary embodiments of ignition coil assemblies including examples of such ignition coil assemblies where an ignition coil assembly can be directly mounted proximate to the spark plugs of an engine such that the need for ignition wires is eliminated. Ignition coil assemblies mounted proximate to the spark plugs can reduce current leakage and reduce electronic interference. In one exemplary application, ignition coil assemblies as described and disclosed herein can be arranged for use with motorcycle engines such as, for example, air cooled v-twin engines.

Figure 1:
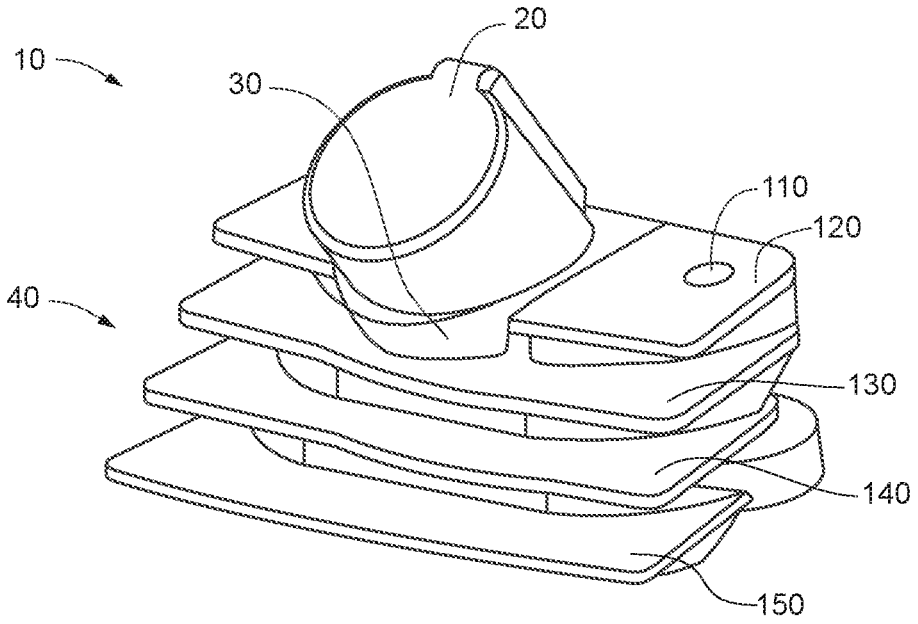
FIG. 1 is a front perspective view of one embodiment of the ignition coil assembly.
Figure 2:
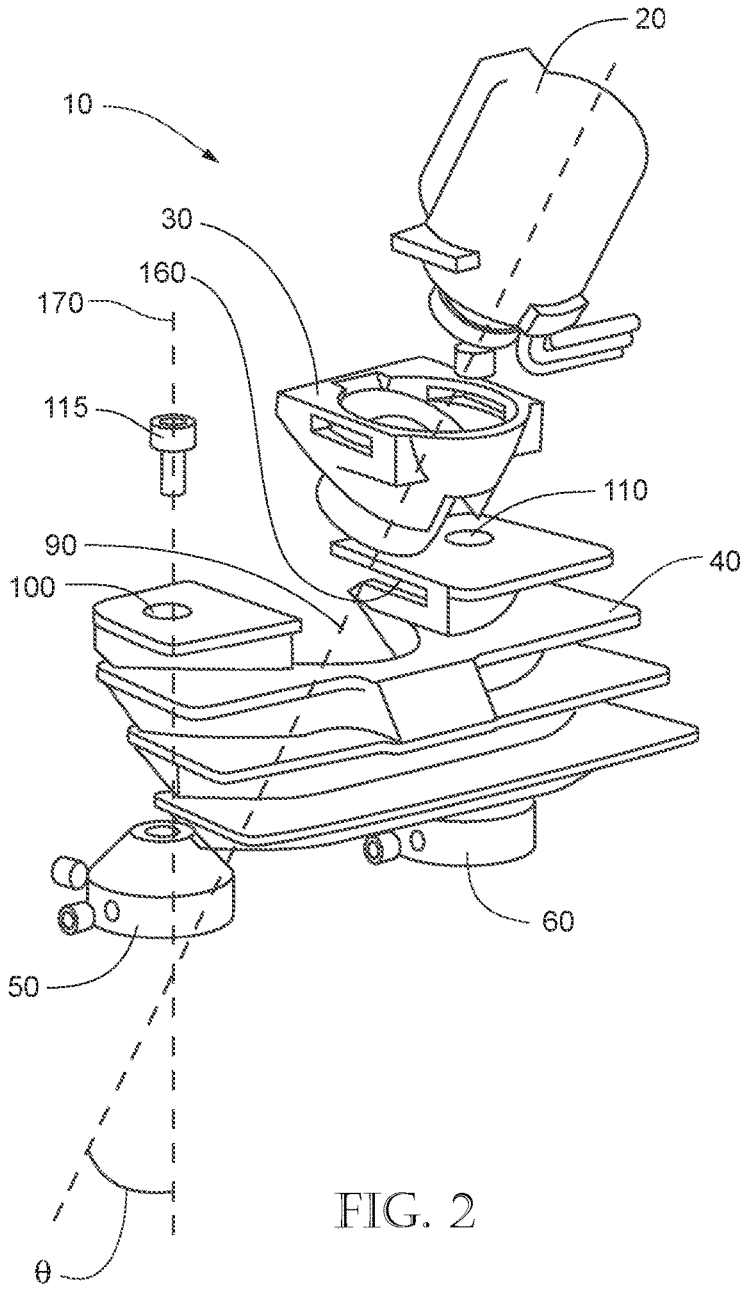
FIG. 2 is a exploded view of one embodiment of the ignition coil assembly.
Figure 3:
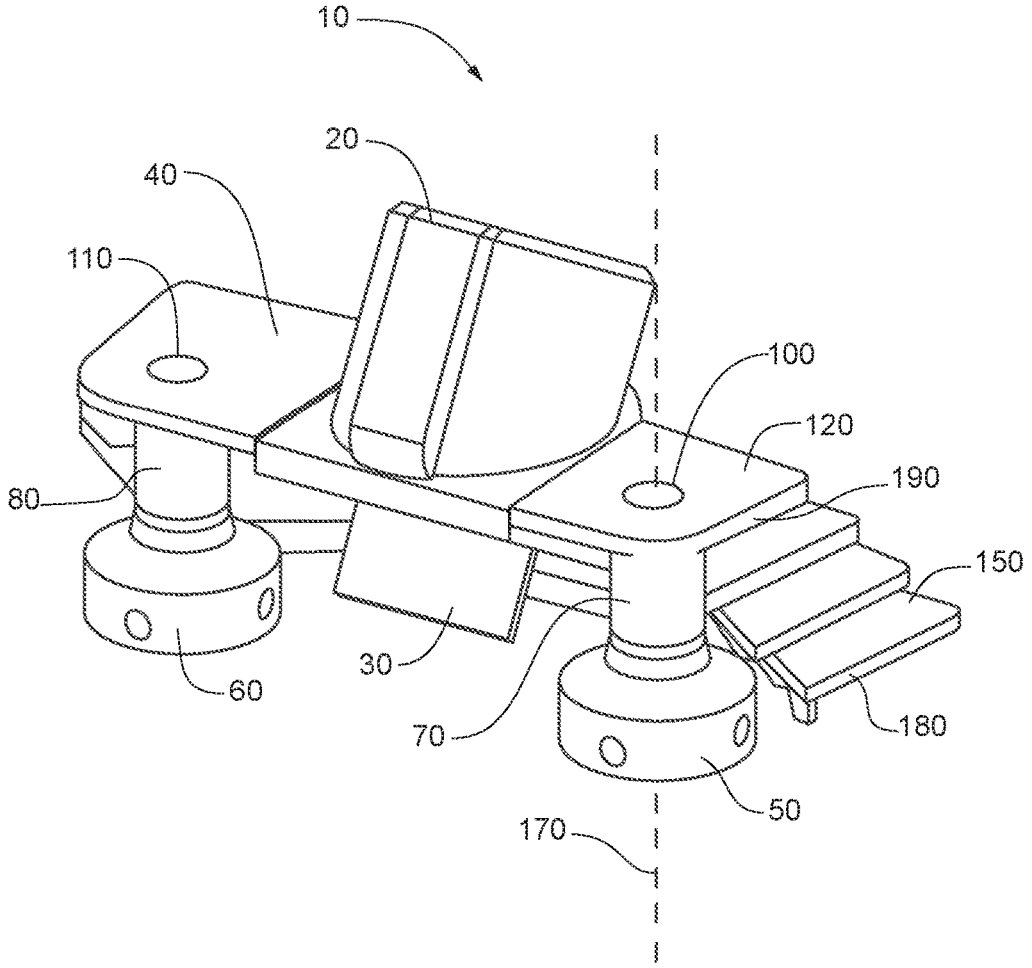
FIG. 3 is a rear perspective view of one embodiment of the ignition coil assembly

FIGS. 1-3 illustrate an exemplary embodiment of an ignition coil assembly 10. The ignition coil assembly 10 includes an ignition coil 20, a boot 30, an ignition coil cover 40, a pair of mounts 50, 60, and a pair of posts 70, 80. In some embodiments, the coil assembly 10 can include or otherwise be coupled to a low voltage (i.e., primary) wiring harness comprising one or more electrical conductors and electrically coupling the ignition coil to a motorcycle electrical system. The ignition coil 20 and boot 30 can be arranged so that the ignition coil 20 and boot 30 can cooperatively engage. For example, the ignition coil 20 can be arranged so that the ignition coil 20 can be inserted or otherwise positioned within the boot 30. In one example, as illustrated in the exploded view of FIG. 2, a portion of the ignition coil 20 can have a generally cylindrical outer shape, and a portion of the boot 30 can have a generally cylindrical inner shape. Therefore, the generally cylindrical outer shape portion of the ignition coil 20 can be inserted into and engage with the generally cylindrical inner shape portion of boot 30.

The boot 30 and ignition coil cover 40 can be arranged to cooperatively engage. In one example, the ignition coil cover 40 can include an opening 90 that accommodates the boot 30. As illustrated in exploded view of FIG. 2, in one embodiment, the opening 90 can be arranged as a generally u-shaped opening, and the boot 30 can be arranged so that a portion of the boot 30 fits within the generally u-shaped opening 90, where a portion of the exterior surface of the boot 30 engaging a portion of the parameter of the u-shaped opening 90. Although the opening 90 of the ignition coil cover 40 is described and illustrated as u-shaped, it will be understood that the opening can be arranged in any number of other shapes and proportions necessary to receive the boot 30. For example, the opening can be, without limitation, square, round, angular or any other geometric shape necessary to receive a boot.

Figure 11:
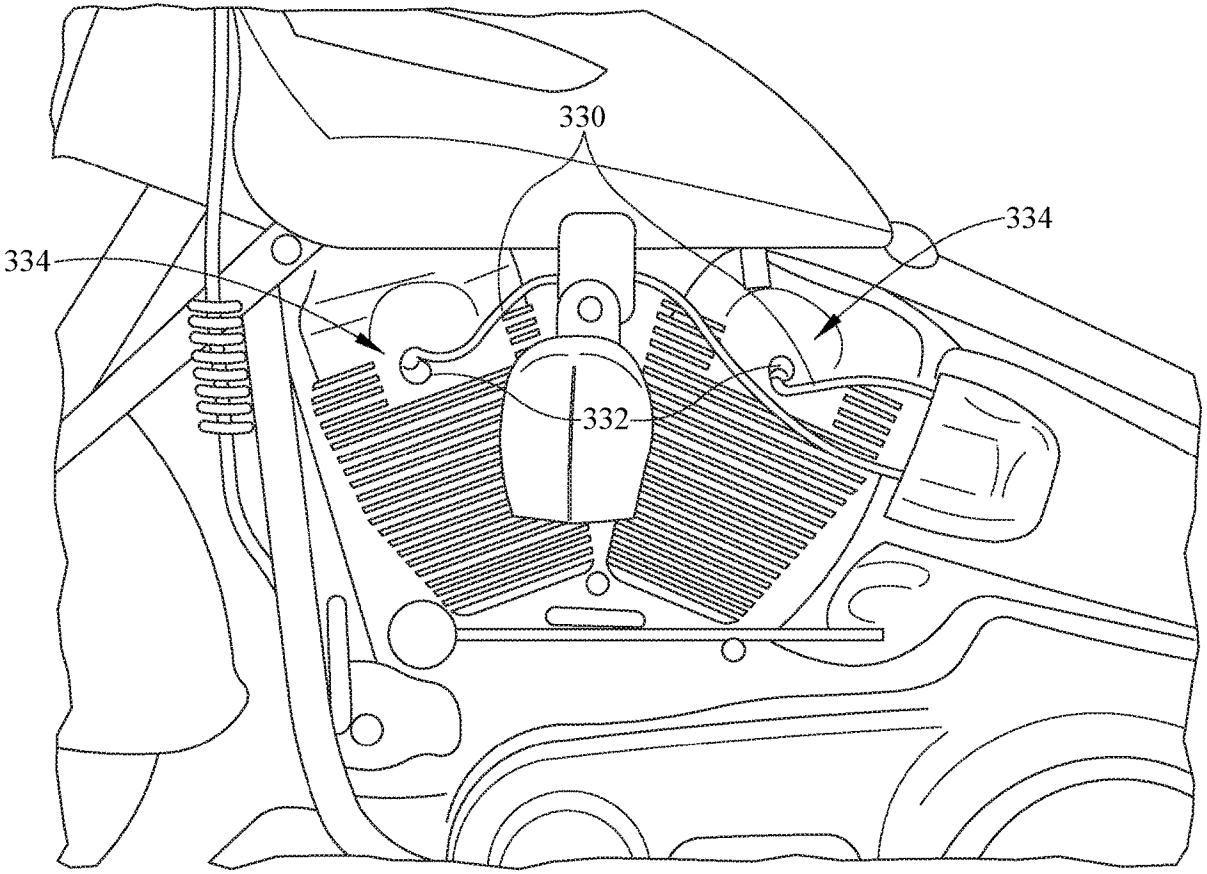
FIG. 11 is a view of an exemplary engine having spark plugs located in plug recesses and connected to a coil by wires.
Figure 12:
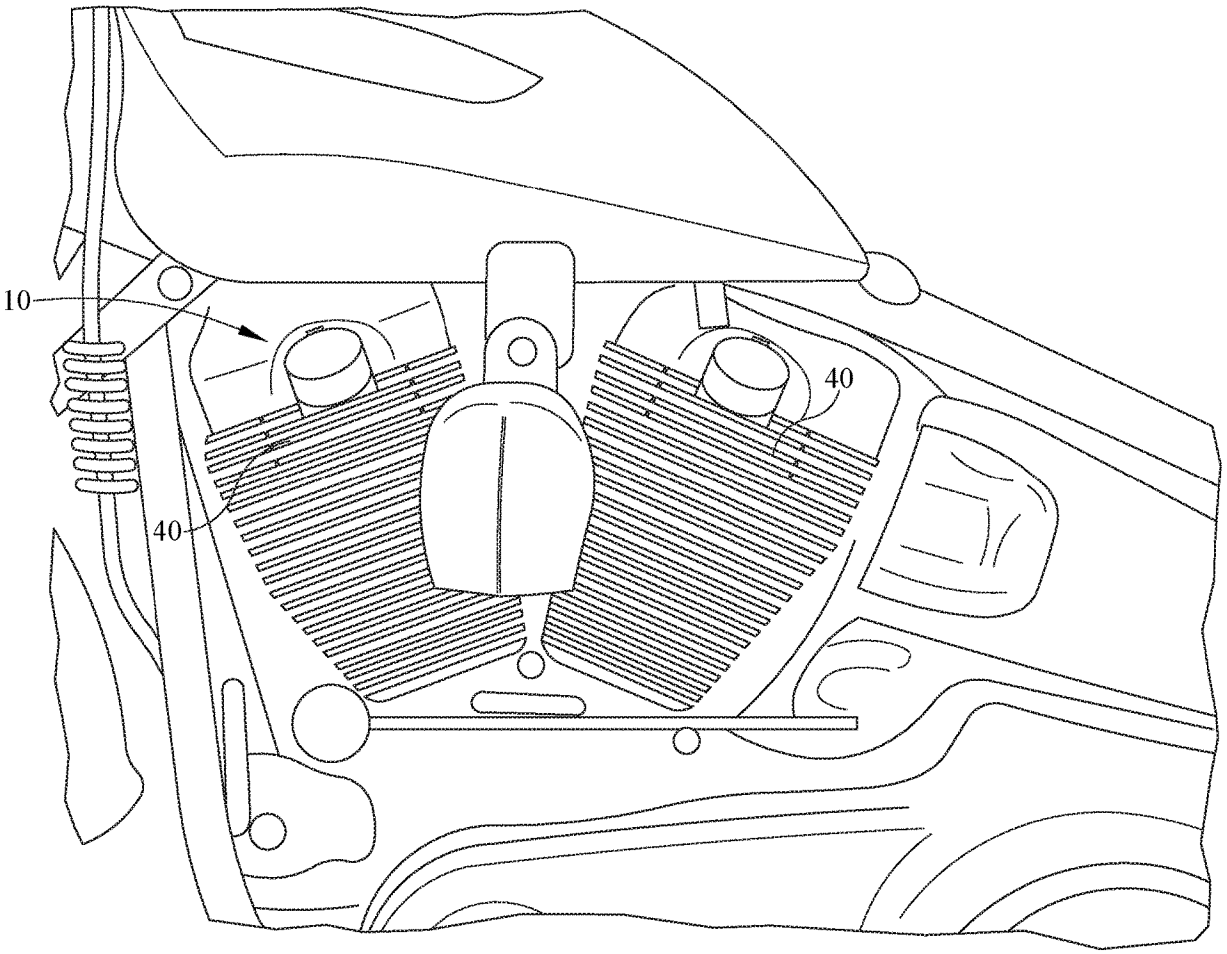
FIG. 12 is a view of the exemplary engine of FIG. 11 wherein ignition coil assemblies substantially fill the plug recesses.

The mounts 50, 60 and the posts 70, 80 can be arranged to be utilized cooperatively to discreetly and directly secure the ignition coil system 10 to an engine of a motorcycle in a position proximate to the spark plugs. Such positioning can result in the elimination of any exterior wiring from the ignition coil to the engine's spark plugs. For example, in some configurations, a motorcycle having external wiring as described can include a plug recess proximate to the spark plugs into which the ignition coil assembly 10 can be disposed. An exemplary plug recess is shown in FIG. 11, in which cable 330 is shown connecting to spark plugs 332 within plug recess 334. In some embodiments, the cover 40 can be such that, when the ignition coil assembly 10 is secured in the plug recess, the cover 40 substantially fills the plug recess. In general, the cover 40 can be configured to fill any amount of the plug recess as desired. In various embodiments, the cover 40 can include an aperture for receiving an end of the spark plug to enable physical and electrical communication with the ignition coil 20. FIG. 12 illustrates an exemplary ignition coil assembly 10 and cover 40, substantially filling the plug recess 334 (FIG. 11).

As illustrated in FIG. 3, the ignition coil cover 40 can include a first aperture 100 and a second aperture 110. One end of a first post 70 can be secured to the ignition coil cover 40 via the first aperture 100, and one end of a second post 80 can be secured to the ignition coil cover 40 via the second aperture 110. Another end of the first post 70 can be secured to a first mount 50, and another end of the second post 80 can be secured to a second mount 60. As will be understood, the first and second posts 70, 80 can be secured to the ignition coil cover by a fastener such as a bolt 115 (as illustrated in FIG. 2). As will be further described herein, the first and second mounts 50, 60 can be secured to an engine, thus, securing the ignition coil assembly 10 to the engine.

Figure 4:
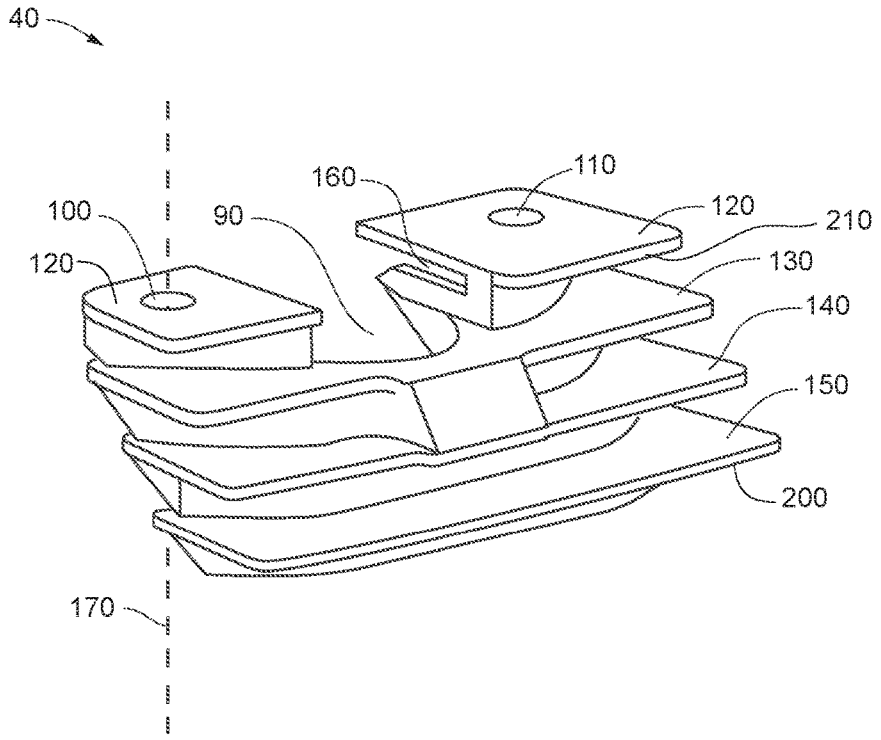
FIG. 4 is a detailed front perspective view of one embodiment of an ignition coil cover used in the ignition coil assembly.

FIG. 4 illustrates an exemplary embodiment of the ignition coil cover 40. The ignition coil cover 40 can include a plurality of fins. For example, in the embodiment illustrated in FIG. 4, the ignition coil cover 40 includes a top fin 120, a pair of intermediate fins 130, 140, and a bottom fin 150. The top fin 120 is arranged as two segments. It will be understood that in the embodiment as shown in FIG. 4, the top fin 120 is arranged in two segments to accommodate the boot 30 as it engages the opening 90 upon assembly of the ignition coil assembly 10. Although the embodiment of FIG. 4 illustrates a ignition coil cover 40 with four fins, it will be understood that an ignition coil cover can be arranged to have more than four or fewer than four fins.

In some embodiments, fins can be configured to conceal wiring, such as a wiring harness for connecting the ignition coil 20 to the electrical system of the motorcycle. In such examples, the wiring harness from the ignition coil assembly 10 is disposed between any pair of adjacent fins of the existing engine housing such that it is concealed from the view of an observer of the motorcycle. In other embodiments, the ignition coil cover 40 is configured to provide clearance or an opening for wiring such as the wiring harness to exit the ignition coil assembly 10 and be concealed from view by fins or other existing features on the motorcycle. Thus, the electrical ignition components of the motorcycle can appear "wireless," as the wired electrical communication between the electrical system of the motorcycle and the ignition coil assembly 10 is concealed from view.

As previously discussed, the ignition coil cover 40 can include an opening 90 and a pair of apertures 100, 110. Furthermore, the ignition coil cover 40 can include at least one channel 160. The at least one channel 160 can be positioned in the top fin 120. Although only one channel 160 is illustrated in FIG. 4, it will be understood that more than one channel can be positioned in the top fin 120. For example a second channel can be positioned opposite the illustrated channel 160 so that one channel is positioned in each of the two segments of the top fin 120, and each channel is exposed to the opening 90 of the ignition coil cover 40.

In the embodiment illustrated in FIG. 4, the fins 120, 130, 140, 150 can be arranged as generally planar and parallel fins. Furthermore, the fins 120, 130, 140, 150 can be generally arranged horizontally. It will be understood that the fins 120, 130, 140, 150 can also be arranged in other relative configurations. For example, the fins 120, 130, 140, 150 can be arranged vertically, diagonally, or in any other suitable arrangement. In one embodiment, the fins 120, 130, 140, 150 of the ignition coil cover 40 are arranged so as to correspond to or match the configuration of the fins of an air cooled v-twin motorcycle engine. Correspondingly, in other embodiments, the fins 120, 130, 140, 150 of the ignition coil cover 40 can be arranged so as to correspond to or match the configuration of the fins of any type of engine.

In general, the ignition coil cover 40 can be die-cast or molded and painted and/or polished into a shape and finish that is aesthetically compatible with the motorcycle and will fit into the plug recess for physical and electrical engagement with the spark plug. For example, the ignition coil cover 40 can be machined and/or designed to match or otherwise complement the design of the surrounding portions of the motorcycle into which the ignition coil assembly 10 is being incorporated. In some embodiments, the ignition coil cover 40 comprises aluminum for convenient manufacturing of a desired ignition coil cover 40.

The fins 120, 130, 140, 150 can be aligned in a stadium style arrangement. This is to say that the each fin extends further forward and/or to the side than the fin above. An example of a stadium style arrangement is illustrated in FIGS. 3 and 4, and will be described in reference to a central axis 170 passing through the first aperture 100 and first post 70. With reference to FIG. 3, in a stadium style arrangement the distance between the central axis 170 and a side edge 180 of the bottom fin 150 is greater than the distance between the center axis 170 and a side edge 190 of the top fin 120. With reference to FIG. 4, in a stadium style arrangement the distance between the central axis 170 and a front edge 200 of the bottom fin 150 is greater than the distance between the center axis 170 and a front edge 210 of the top fin 120.

In one embodiment, the posts 70, 80 are generally disposed on opposing sides of the opening 90 and abut the underside of the top fin 120. In another example, the posts 70, 80 can abut any of the plurality fins 120, 130, 140, 150 of the ignition coil cover 40. In one embodiment, each post 70, 80 is substantially vertical and has a central axis 170 that is substantially perpendicular to the plurality of horizontal fins 120, 130, 140, 150. Alternatively, the posts 70, 80 can be oriented at an angle with reference to the horizontal fins 120, 130, 140, 150. One of ordinary skill in the art upon reading this disclosure would recognize that posts can be located elsewhere in the ignition coil assembly 10, including without limitation, the boot 30 or the ignition coil 20. In yet another embodiment posts may be omitted altogether.

Although the ignition coil assembly 10 is illustrated with the ignition coil cover 40 having a pair of apertures 100, 110, a pair of corresponding posts 70, 80, and corresponding mounts 70, 80 disposed on either side of the opening 90, it will be understood that an ignition coil assemblies can include other quantities and arrangements of apertures, posts and mounts. For example an ignition coil assembly may include more or less than two apertures, posts, and/or mounts. The functions performed by the mounts and posts can be served by a single component instead of individual components.

Figure 5:
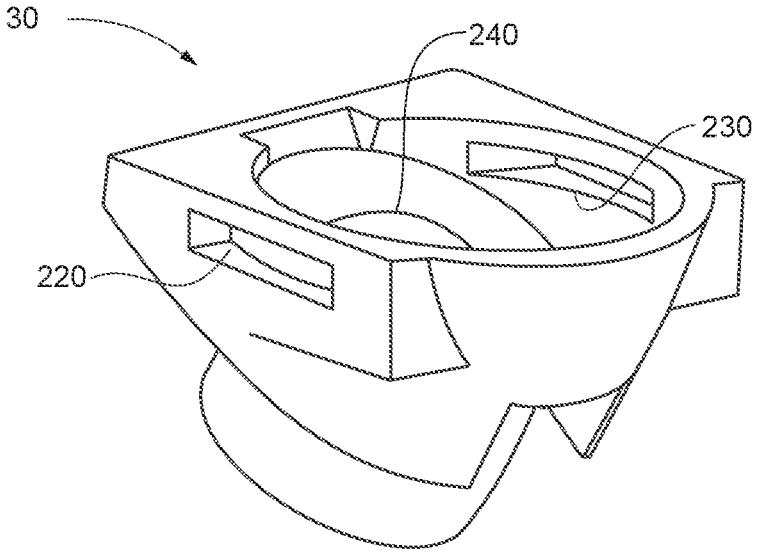
FIG. 5 is a perspective view of a boot used in one embodiment of the ignition coil assembly.
Figure 6:
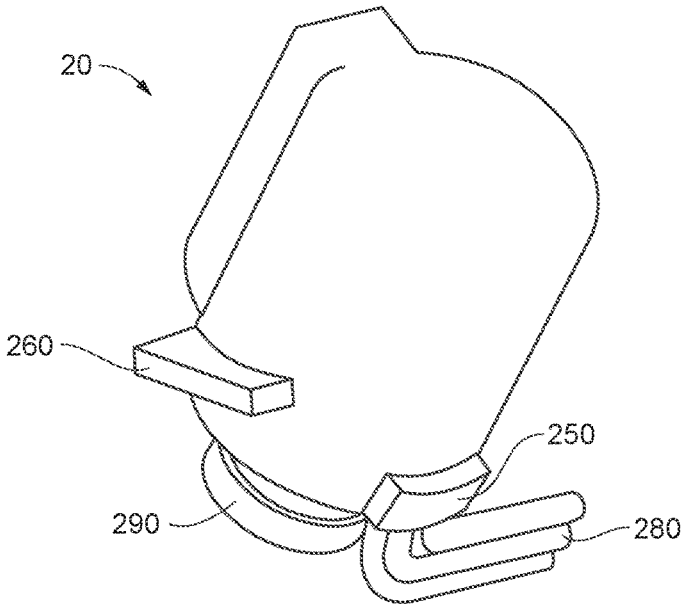
FIG. 6 is a perspective view of an ignition coil used in one embodiment of the ignition coil assembly.
Figure 7:
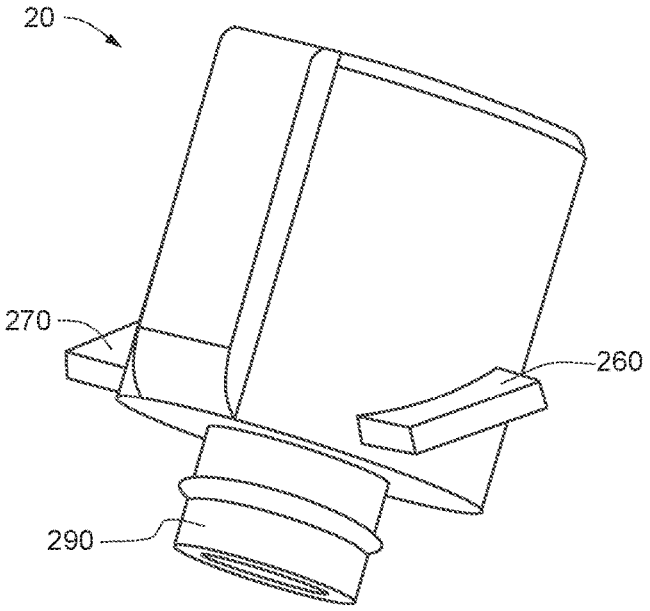
FIG. 7 is a perspective view of an ignition coil used in one embodiment of the ignition coil assembly.

FIG. 5 illustrates an exemplary embodiment of a boot 30, and FIGS. 6 and 7 illustrate an exemplary embodiment of an ignition coil 20. The ignition coil 20, the boot 30 and the ignition coil cover 40 can be arranged so that the ignition coil 20 and the boot 30 engage via a snap-fit arrangement; and, furthermore, the assembly of the ignition coil 20 and the boot 30 engage the ignition coil cover 40 via a snap-fit arrangement. As noted above, the ignition coil cover 40 includes at least one channel 160, and in an embodiment, the ignition coil cover 40 includes two channels 160. As illustrated in FIG. 5, the boot 30 can include two slotted openings 220, 230 positioned on either side of a centralized orifice 240. The centralized orifice 240 is arranged to support the ignition coil 20.

As illustrated in FIGS. 6 and 7, the ignition coil 20 includes a seat 250 for supporting the ignition coil 20 within the centralized orifice 240 of the boot 30. The ignition coil 20 further includes two tabs 260, 270 on opposing sides of the ignition coil 20. The tabs 260, 270 are dimensioned to be insertable into the slotted openings 220, 230 on either side of the boot 30 so as to secure the ignition coil 20 to the boot 30. The ignition coil 20 can further include at least one wire 280 and a plug receptor 290 disposed at a distal end of the ignition coil 20. The plug receptor 290 can be electrically connected to a spark plug (not shown).

In general, the ignition coil assembly 10 is configured to engage and mate with a spark plug in an ignition system. The ignition coil 20 can be physically and electrically coupled to the spark plug via, for example, a plug receptor 290. To secure the ignition coil 20 in place, the ignition coil 20 can be secured to a boot 30. The boot 30 can then be received by the ignition coil cover 40, which can be mounted to the engine in direct contact with the spark plug. In various embodiments, various methods of securing these components to one another and the engine can be incorporated. In addition, components can be assembled or secured to one another or the engine in varying order.

Figure 8:
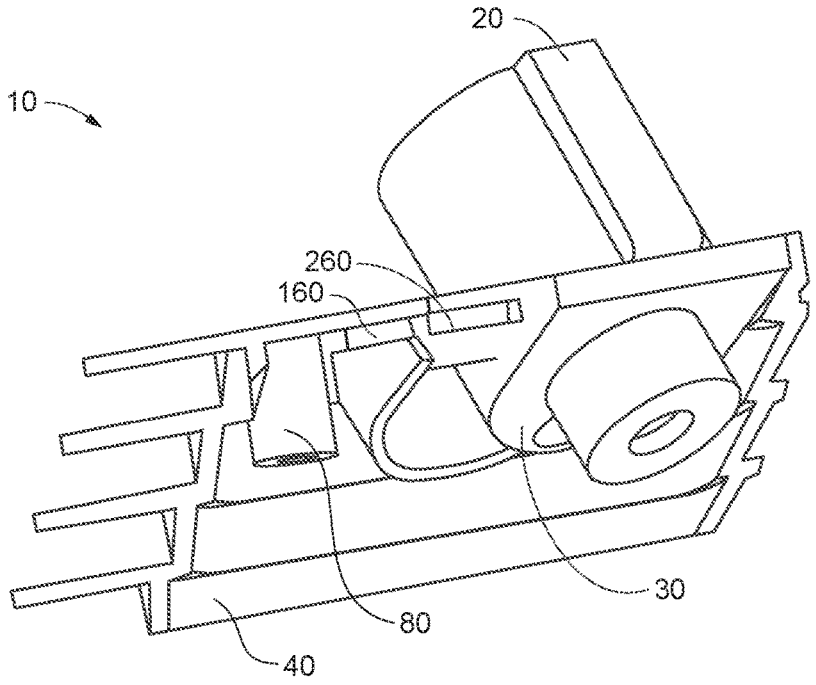
FIG. 8 is a rear perspective view of one embodiment of an ignition coil assembly showing the boot and ignition coil disengaged from the ignition coil cover.
Figure 9:
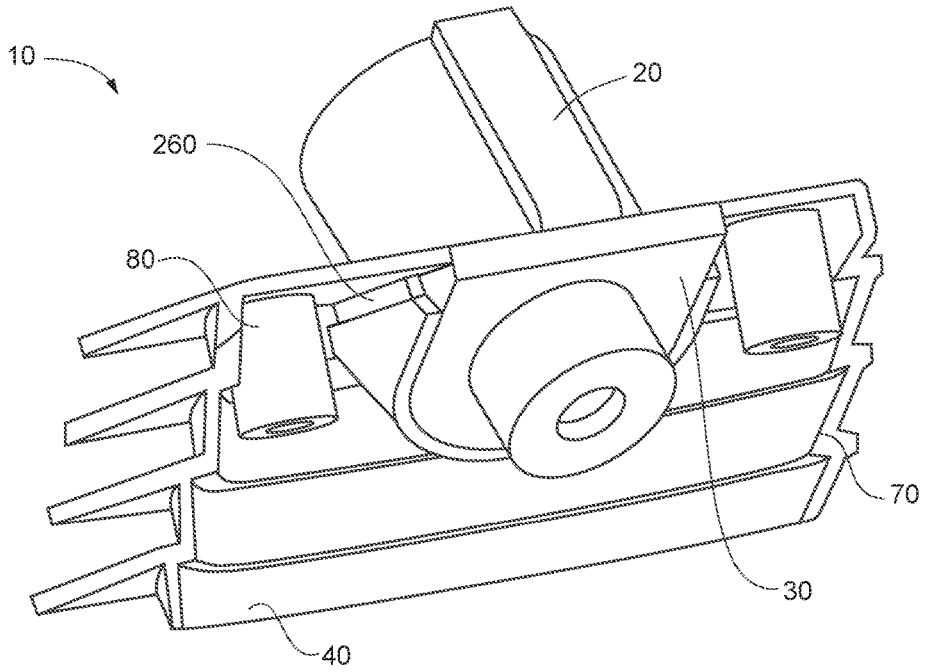
FIG. 9 is a rear perspective view of one embodiment of the ignition coil assembly showing the boot and ignition coil engaged with the ignition coil cover.

FIGS. 8 and 9 illustrate a rear view of an assembly of the ignition coil 20, boot 30, and ignition coil cover 40. As discussed previously and as illustrated in FIG. 3, the ignition coil cover 40 can include channels 160 that are configured to attach the boot 30 and the ignition coil 20 to the ignition coil cover 40. Channels 160 can be arranged on either side of the opening 90 of the ignition coil cover 40 and arranged and dimensioned to receive the tabs 260, 270 located on either side of the ignition coil 20. In such an embodiment, when the ignition coil 20 is assembled with the boot 30, the tabs 260, 270 protrude through the slotted openings 220, 230 of the boot 30. As illustrated in FIGS. 8 and 9, the tabs 260, 270 not only secure the ignition coil 20 to the boot 30 by engaging the slotting openings 220, 230, but also secure the assembly of the ignition coil 20 and the boot 30 to the ignition coil cover 40 by further engaging the channels 160 of the ignition coil cover. It will be understood that the ignition coil 20 and/or boot 30 can alternatively be secured in the channels 160 in any number of ways, including without limitation, snapping, molding, interlocking, screwing, and equivalents thereof.

Referring again to FIG. 2, the ignition coil 20 can be snap-fitted to the boot 30 and the ignition coil cover 40 at an angle (θ) that is less than 90 degrees with respect to the central axis 170 through the first aperture 100 and the first post 70. In alternative embodiments, the ignition coil 20 may be disposed in the boot 30 and the ignition coil cover 40 at an angle that is equal to or greater than 90 degrees with respect to the central axis 170.

Figure 10:
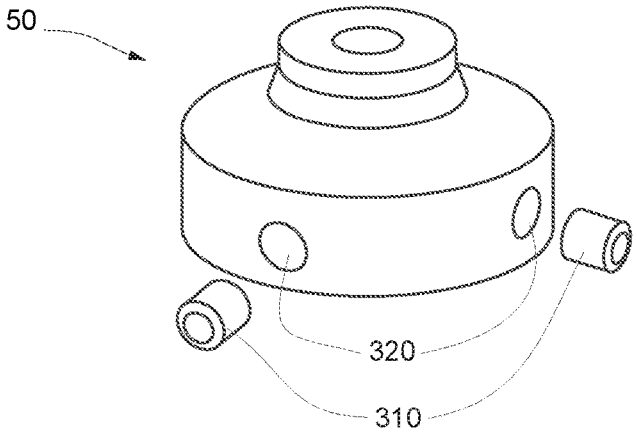
FIG. 10 is a perspective view of a mount used in one embodiment of the ignition coil assembly.
Figure 13B:
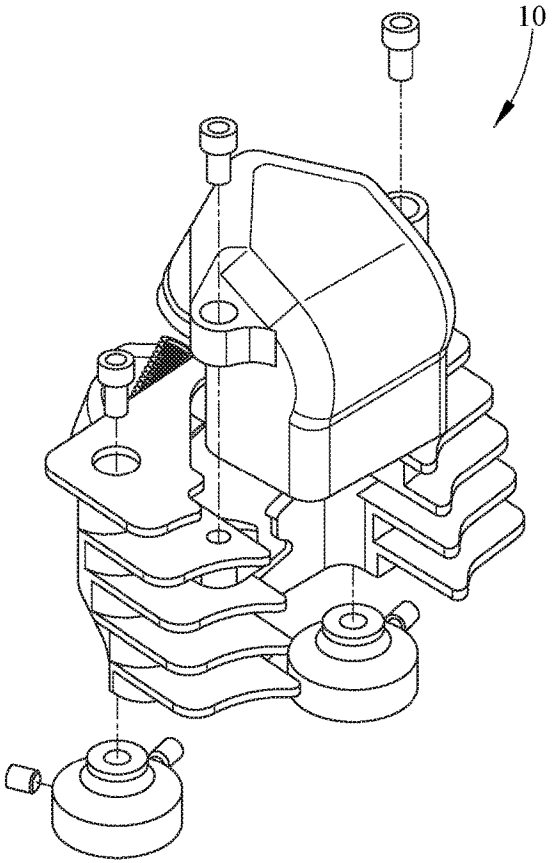
FIGS. 13A and 13B illustrate front and back views of an exemplary ignition coil systems having similar features as embodiments herein described.
Figure 13A:
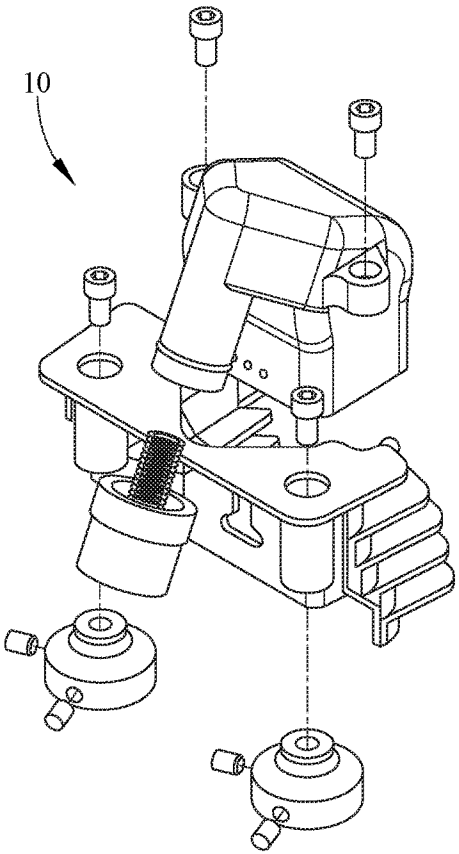
Figure 14:
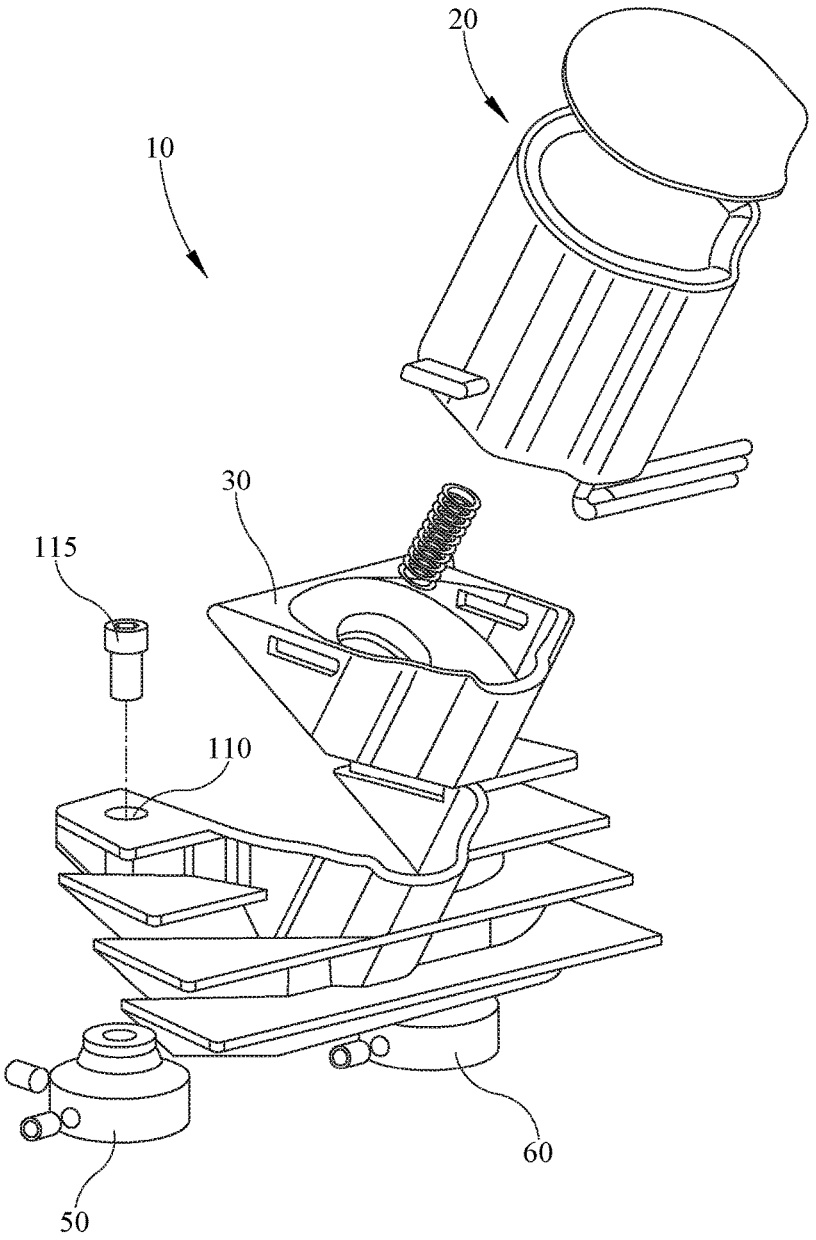
FIG. 14 illustrates an exploded view of a further embodiment of an ignition coil system.

As shown in FIG. 10, a mount 50 of the ignition coil assembly 10 can be dimensioned to receive a post 70. The mount 50 can be used to attach the ignition coil assembly 10 to an engine by one or more attachment member 310 passing through one or more apertures 320. The attachment member 310 may be a bolt, screw, rivet, nail, weld, tie, or any fastener, and equivalents thereof. Alternatively, the mount 50 can be secured to the engine with an adhesive or other suitable method of attachment. FIGS. 13A and 13B illustrate front and back views of an exemplary ignition coil systems having similar features as embodiments herein described. FIG. 14 illustrates an exploded view of a further embodiment of an ignition coil system.

Various examples have been described. It will be appreciated that, in various embodiments, the assembly of the ignition coil assembly 10 can be done in a number of ways. For example, in some embodiments, the ignition coil 20 can be secured to the boot 30 and the ignition coil cover 40 secured to the engine proximate the spark plug, after which the ignition coil/boot assembly can be secured to the engine via the ignition coil cover. In other embodiments, the ignition coil 20 and boot 30 are secured to the ignition coil cover 40 prior to securing the ignition coil assembly 10 to the engine proximate the spark plug. In general, among various embodiments, the components of the ignition coil assembly 10 can be assembled in any order while securing the ignition coil assembly 10 to an engine.

Figure 15:
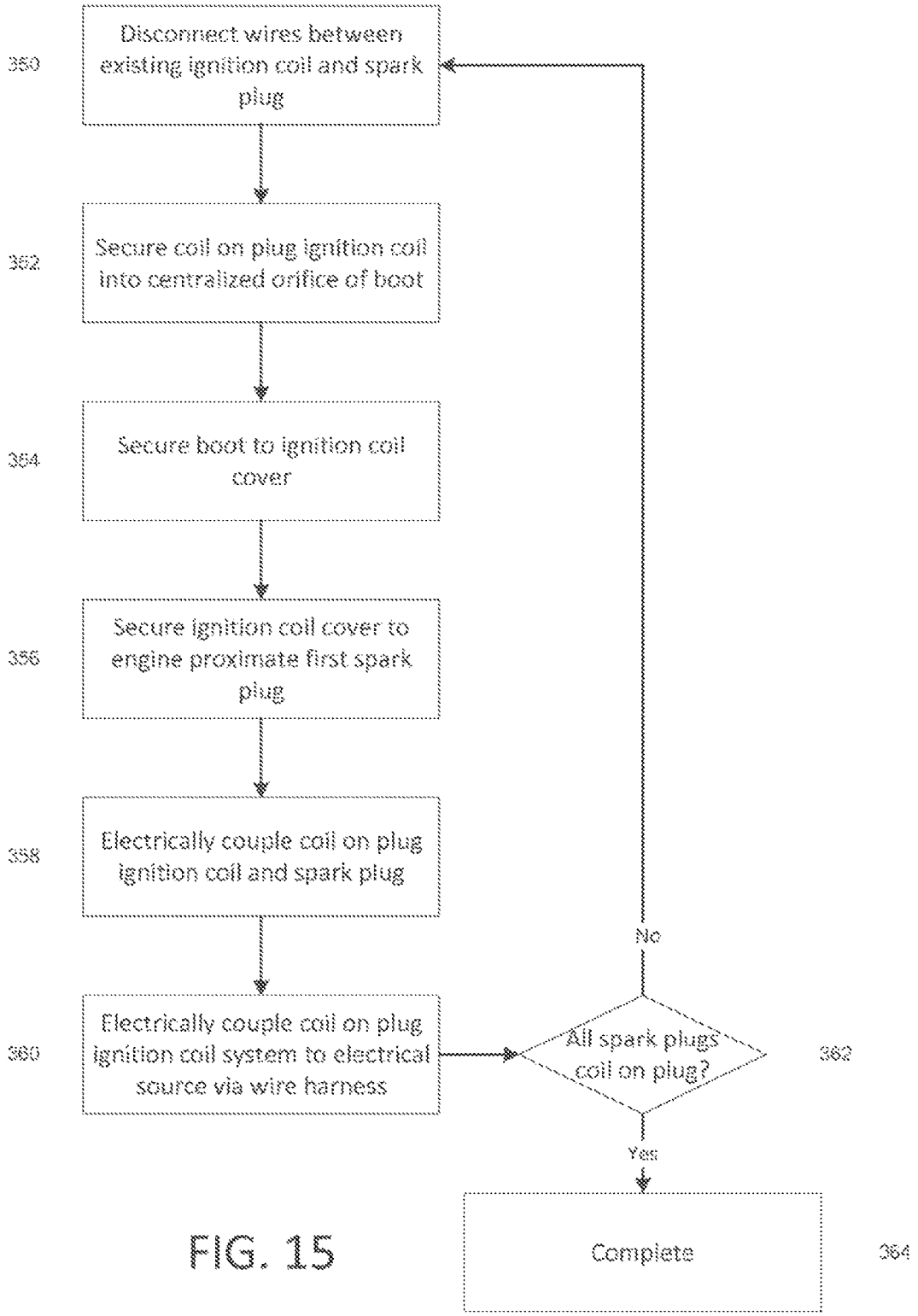
FIG. 15 is a process flow diagram illustrating an exemplary method for implementing a coil on plug system into a traditionally wired engine.

As discussed, present coil-on-plug systems are specifically designed for the engine with which is it being used by the engine manufacturer. However, because such systems are specifically designed, incorporating a coil-on-plug arrangement into an engine not originally designed for it can be difficult. Accordingly, some embodiments of the invention are directed toward a method for implementing a coil-on-plug system into a traditionally wired engine. FIG. 15 is a process flow diagram illustrating such an exemplary method. In an exemplary method, the wires connecting an existing ignition coil and a spark plug are removed or disconnected 350. A coil-on-plug ignition coil is electrically coupled 358 to the spark plug. In some configurations, the coil-on-plug ignition coil is housed and secured 352 within a boot. An ignition coil cover is secured 356 to the engine, and the ignition coil and/or boot is secured 354 to the ignition coil cover.

It should be noted that the method described above can be performed with various steps omitted or permuted. For example, in an alternative method, an ignition coil, boot, and ignition coil cover can be assembled separately from the engine, forming an ignition coil assembly (steps 352, 354). Among various embodiments, the ignition coil assembly can be assembled in a variety of configurations and methods. The assembled ignition coil assembly can be secured to the engine proximate the spark plug (in a step similar to 356), and the ignition coil can be physically and electrically coupled 358 to the spark plug. In some embodiments, the method further comprises electrically coupling 360 a wire harness from the ignition coil assembly to the electrical system of, for example, a motorcycle. The wire harness can be concealed 362 from view by disposing the wire harness within various components of the ignition coil assembly and/or the engine. Any method herein described can be repeated for each existing spark plug. If 362 all spark plugs are configured in a coil-on-plug arrangement, the conversion from the standard wired configuration to a coil-on-plug configuration is complete 364 and appears wireless.

While the present disclosure has been illustrated by the description of embodiments thereof, and while the embodiments have been described in considerable detail, it is not the intention of the applicants to restrict or in any way limit the scope of the described embodiments to such detail. Additional advantages and modifications will readily appear to those skilled in the art. Therefore, the disclosure, in its broader aspects, is not limited to the specific details, the representative apparatus and method, and illustrative examples shown and described. Accordingly, departures may be made from such details without departing from the spirit or scope of the applicant's general inventive concept.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

Various features herein described can be found in one or more of the following embodiments:

1. An ignition coil assembly comprising: an ignition coil cover comprising an opening, at least one channel, and a plurality of fins; a boot comprising at least one slotted opening and a centralized orifice, and configured to be disposed within the opening of the ignition coil cover; and an ignition coil configured to be disposed within the centralized orifice of the boot and comprising at least one tab configured to be inserted into the slotted opening and the channel when the ignition coil is disposed within the centralized office and the boot is disposed within the opening.
2. The ignition coil of embodiment 1 further comprising at least one post attached to a top fin of the plurality of fins and at least one aperture in the top fin.
3. The ignition coil of embodiment 2 further wherein a central axis of the at least one post is substantially perpendicular to the plurality of fins.
4. The ignition coil of embodiment 3 where the ignition coil further comprising a seat capable of supporting the ignition coil within the centralized orifice of the boot.
5. The ignition coil assembly of embodiment 4 further comprising at least one mount attached to the at least one post.
6. The ignition coil assembly of embodiment 4 wherein the fins are aligned in a stadium style arrangement.

What is claimed is:

1. A method of retrofitting a motorcycle ignition coil, comprising the steps of:

disconnecting existing wires between at least one existing ignition coil and at least one spark plug of a motorcycle engine;

securing a coil-on-plug ignition coil into a centralized orifice of a boot; and securing the boot to an ignition coil cover; and securing the ignition coil cover with the boot to the motorcycle engine, proximate the spark plug, to create a coil-on-plug ignition coil system; and electrically coupling the coil-on-plug ignition coil and the spark plug;

wherein the ignition coil cover has a plurality of fins arranged in a stadium style and the fins of the ignition coil cover are lined up with existing fins on the motorcycle engine.

2. A method according to claim 1, further comprising the step of:

electrically coupling the coil-on-plug ignition coil system to an electrical source of a motorcycle via a wire harness.

3. A method of retrofitting a motorcycle ignition coil, comprising the steps of:

disconnecting existing wires between at least one existing ignition coil and at least one spark plug of a motorcycle engine;

securing an ignition coil cover to the motorcycle engine, proximate the spark plug;

securing a coil-on-plug ignition coil into a centralized orifice of a boot;

securing the boot to the ignition coil cover, to create a coil-on-plug ignition system; and electrically coupling the coil-on-plug ignition coil and the spark plug, wherein the ignition coil cover has a plurality of fins arranged in a stadium style and the fins of the ignition coil cover are lined up with existing fins on the motorcycle engine.

4. A method according to claim 3, further comprising the step of electrically coupling the coil-on-plug ignition system to an electrical source of a motorcycle via a wire harness.

5. A method of retrofitting a motorcycle ignition coil, comprising the steps of:

disconnecting existing wires between at least one existing ignition coil and at least one spark plug of a motorcycle engine;

securing an ignition coil cover to the motorcycle engine, proximate the spark plug;

securing a coil-on-plug ignition coil to the ignition coil cover to create a coil-on-plug ignition coil system;

electrically coupling the coil-on-plug ignition coil and the spark plug;

wherein the ignition coil cover has a plurality of fins arranged in a stadium style and the fins of the ignition coil cover are lined up with existing fins on the motorcycle engine.

6. A method according to claim 5, further comprising the step of:

electrically coupling the coil-on-plug ignition coil system to an electrical source of a motorcycle via a wire harness.

* * * * *